US005975163A

United States Patent [19]

Gianfranco

[11] Patent Number: 5,975,163

[45] Date of Patent: Nov. 2, 1999

[54] BAG FILLING VALVE FOR VISCOUS FLUIDS

[75] Inventor: Angeli Gianfranco, Turin, Italy

[73] Assignee: Techpack S.r.l., Bra, Italy

[21] Appl. No.: 09/112,215

[22] Filed: Jul. 9, 1998

[51] Int. Cl.[6] ..... B65B 1/04

[52] U.S. Cl. ..... 141/313; 141/39; 141/59; 141/61; 141/65; 141/311 R; 141/312; 141/285; 141/302

[58] Field of Search ..... 141/39, 59, 61, 141/63, 64, 65, 66, 67, 68, 114, 285, 311 R–317, 383, 302; 53/432, 510

[56] References Cited

U.S. PATENT DOCUMENTS

| | | | |
|---|---|---|---|
| 4,283,901 | 8/1981 | Schieser et al. | 53/75 |
| 4,493,349 | 1/1985 | Pomponio, Sr. | 141/59 |
| 5,720,326 | 2/1998 | Kaneko | 141/67 |

*Primary Examiner*—Steven O. Douglas
*Assistant Examiner*—Timothy L. Maust
*Attorney, Agent, or Firm*—Guido Modiano; Albert Josif; Daniel J. O'Byrne

[57] ABSTRACT

A housing (10) has a cavity (18) to which fluid product can be fed, and which opens into a terminal neck (20) adapted to be inserted over a bag straw. A hollow bolt (28), having a bore at its tip, is slidable in the housing between a neck-shutting position and a position in which its tip is remote from the neck mouth. A needle (34) is axially slidable in the bolt and protrudes with an enlarged head (35) within the terminal neck through the terminal bore. The needle is biased by a spring (38) to a position where the enlarged head abuts against the tip of the bolt. A drive cylinder (44) is provided for moving the bolt and the needle away from the terminal neck, for connecting the bolt to the internal cavity of the housing, for subsequently bringing the bolt near the neck in order to break the connection and to push the needle so that its enlarged head moves away from the bolt. The portion of the needle adjacent to its enlarged head is smaller than the bore, so that gas fed to the hollow bolt is allowed to flow through.

4 Claims, 2 Drawing Sheets

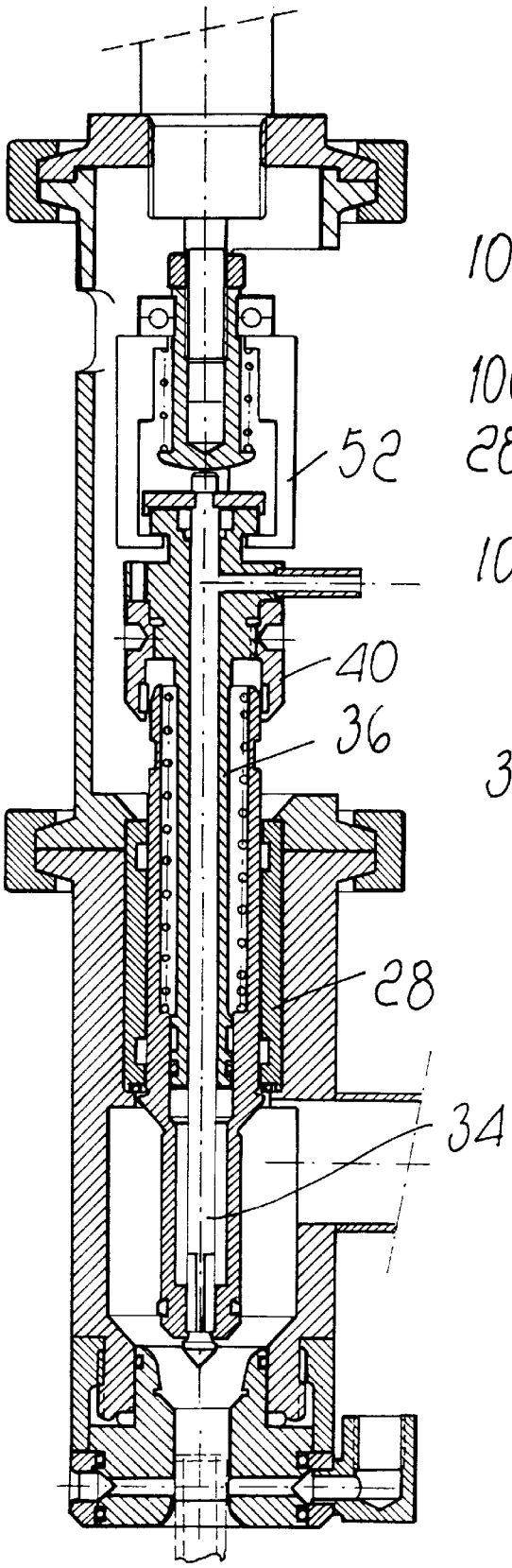
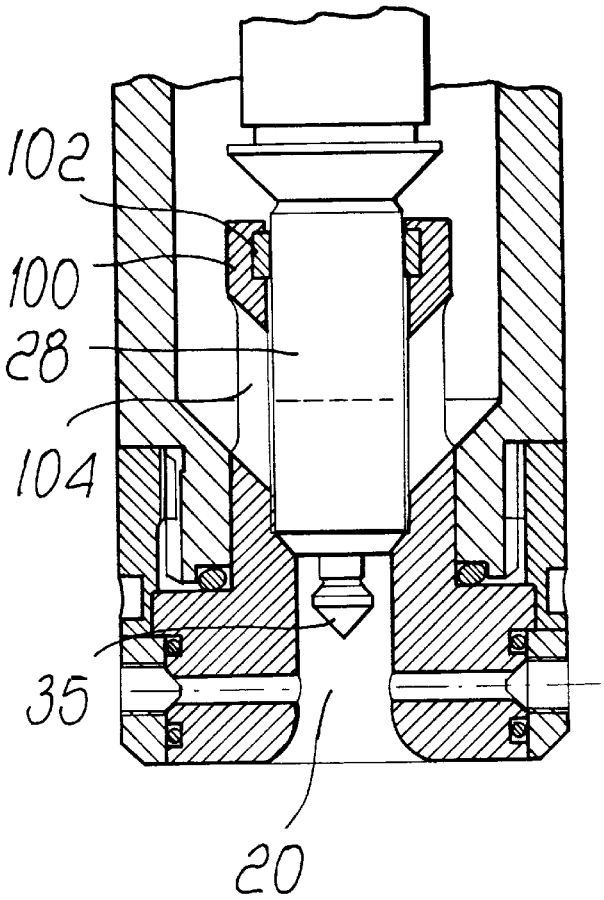
FIG. 3
FIG. 2

BAG FILLING VALVE FOR VISCOUS FLUIDS

BACKGROUND OF THE INVENTION

This invention is concerned with a filling or metering valve for use in filling flexible bags with viscous fluids, such as with cream, yoghurt, honey, fruit juices, medicines and other viscous products.

The process of filling flexible bags with viscous substances, particularly foods, has been difficult to automate. Firstly, the very viscosity of the material requires injection under pressure. Secondly, it is necessary that a vacuum is preliminarily made in the bag, in order to avoid that air pockets are trapped inside it. Lastly, considerations of convenience require that the bag is only filled up to a certain level, a sterile, non-oxidizing atmosphere (typically nitrogen) being formed above it.

These steps should be completed while preventing the product both from dripping outside the bag and soiling it and from leaking into undesired areas of the equipment, so as to avoid, on the one hand, that the product causes clogging of the duct, which would adversely affect the operation of the apparatus, and also, on the other hand, that hotbeds of bacterial proliferation may develop in places that are difficult to access and therefore difficult to sanitize. Known filling bags achieve one or the other of the aims above, but they generally fail to satisfy all requirements.

It is the main object of the invention to provide a filling valve for flexible bags, by which a predetermined dose of a fluid substance, even of a high viscosity, can be injected into a bag, with preliminary suction and subsequent introduction of an inert gas, and while preventing the viscous product both from dripping onto the bag and from coming into contact with pairs of the valve not directly belonging to its path.

SUMMARY OF THE INVENTION

The above object, as well as other objects and advantages such as will appear from the disclosure, are achieved by the invention with a bag filling valve having the features recited in claim 1.

BRIEF DESCRIPTION OF THE DRAWINGS

A preferred embodiment of the invention will now be described, with reference to the enclosed drawings, wherein:

FIG. 2 is a view similar to FIG. 1, in a different operating condition of the valve; and FIG. 3 is an enlarged view in axial cross-section of a detail of a variation on the embodiment of FIG. 1.

DESCRIPTION OF PREFERRED EMBODIMENTS

Figure 1:
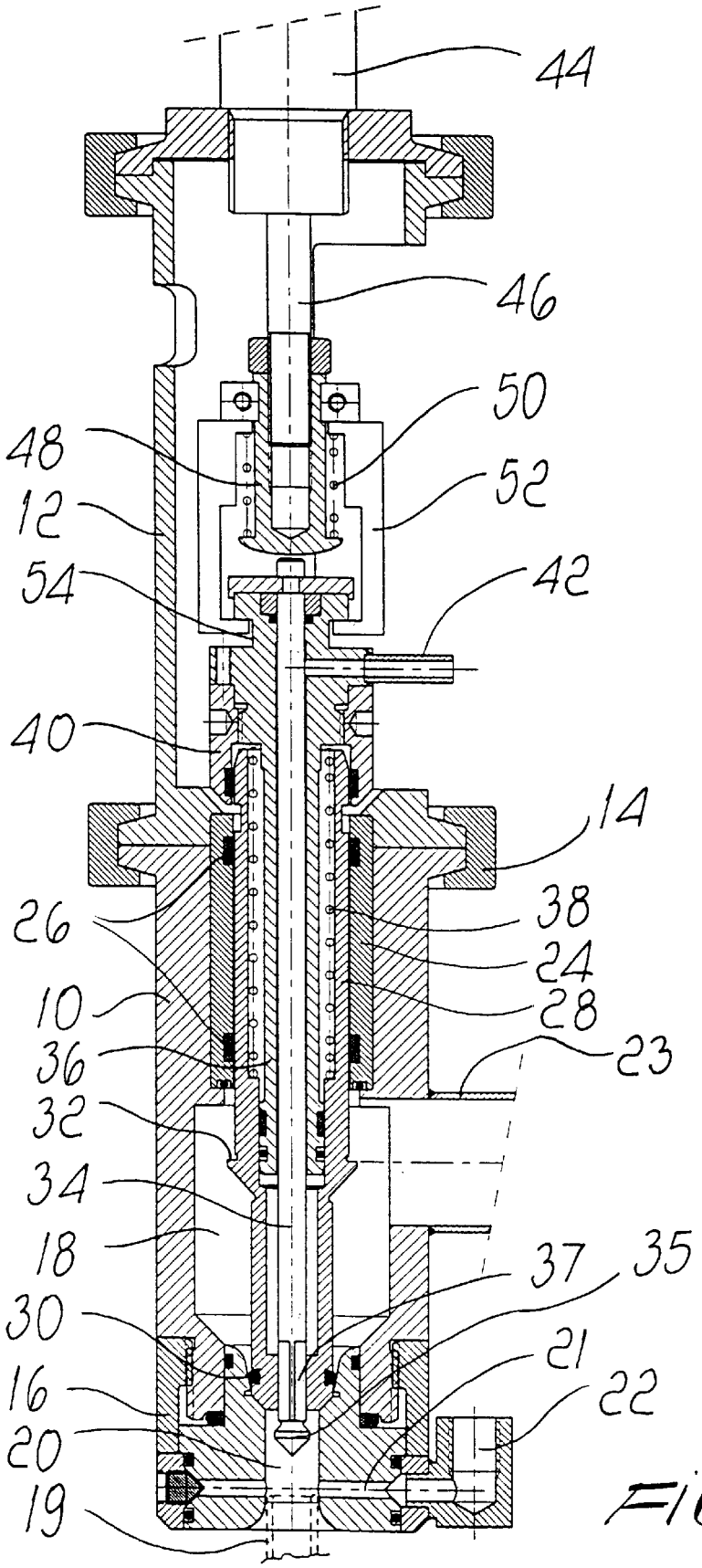
FIG. 1 is a view in axial cross-section of a filling valve according to a preferred embodiment of the invention, in an operating condition of rest.

With reference to FIG. 1, a filling valve according to the invention comprises a metallic tubular housing 10, which is assembled with an attachment 12 by means of a locking ring 14. Housing 10 is threaded at the bottom in a mounting bracket 16 of a filling equipment or machine, not shown, known in the art, suitable for filling flexible bags.

Housing 10 has an inside cavity 18, downwardly tapering down to a neck 20, adapted to rest onto a filling straw 19 of a flexible bag, known per se. A transverse passage 21 opens into neck 20, and leads to a connector 22 for connection with a vacuum pump not shown.

Cavity 18 is in communication with a product-feeding side duct 23, which is fed by a pump not shown. Cavity 18 extends upward into a cylindrical passage where a sleeve 24 is received. Within sleeve 24, which is provided with gaskets 26, a hollow bolt 28 is slidably received, which is provided, at its bottom end, with a sealing ring 30 for shutting off neck 20, and with a step 32 for upward stop abutment.

A needle 34 is slidably received within hollow bolt 28. Needle 34 is partially jacketed in a sheath 36, which is itself sealingly slidable within hollow bolt 28 against the reaction of a helical compression spring 38, and is provided, at its top, with a nut 40 adapted to slidably embrace the upper end of hollow bolt 28. The diameter of needle 34 is slightly less than the inside diameter of sheath 36, so that a gap is formed which is in communication with a connector 42 for connection with a source of nitrogen, not shown.

Needle 34 projects downwardly through a bore in the tip of hollow bolt 28, and is provided with an enlarged head 35. The portion of needle 34 near head 35 is faceted, in order to allow gas to flow along the bore.

A pneumatic cylinder 44 is vertically mounted on the top of attachment 12 of housing 10. An operating rod 46 of pneumatic cylinder 44 integrally carries a mushroom-shaped hammer 48 at its end. Hammer 48 also elastically carries, by the intermediate of a helical compression spring 50, a bracket 52 hanging from a groove 54 in sheath 36.

The operation of the above-described filling valve will now be explained with reference to both FIGS. 1 and 2. After abutting the straw of the bag due to be filled against the flared mouth of neck 20, and while maintaining bolt 28 lowered against its funnel-shaped seat in order to shut off neck 20, suction is applied to connector 22 in order to create a vacuum in the flexible bag. At the end of this step, the straw of the bag is pushed home into neck 20, by means not shown, thus masking the transverse passage 21.

Pneumatic cylinder 44 is then driven to raise rod 46 and consequently, through the intermediate of bracket 52, both sheath 36 and needle 34, until the enlarged head 35 of needle 34 abuts against the tip of bolt 28 and drags it upwards, thus pushing the bolt away from its seat and allowing fluid product to be injected from cavity 18 to neck 20 and from there into the straw.

After the desired dose of fluid product has been introduced, rod 46 is lowered, so that hammer 48 pushes needle 34 downwards, and immediately afterwards, after compressing spring 38 until abutment of the head of sheath 36 against the top of bolt 28, also pushes the latter until it abuts against its funnel-shaped seat, in order to intercept all communication between cavity 18 and neck 20, while head 35 of needle 34 again moves away form the tip of bolt 28. Nitrogen is now blown in through connector 42. The nitrogen flows along the gap between needle 34 and sheath 36 and along the facets 37 of the needle and eventually through neck 20 and into the bag, thus shoving back into the bag any traces of product that might possibly stick to the free walls of neck 20, to the tip of bolt 28 or to the enlarged head 35 of needle 34.

It can be seen from the above disclosure that the fluid product is strictly confined to cavity 18 and neck 20 (and the bag itself) at all times during the operating cycle. When suction is applied to passage 21, bolt 28 shuts off cavity 18 from the neck, and there is no opportunity that traces of product are sucked together with air. Subsequently, before bolt 28 is raised to allow the fluid product to flow from cavity 18 into neck 20, head 35 of needle 34 plugs the forward bore on bolt 20, while the bag straw has already entered completely into neck 20, thus plugging passage 21. Finally, when bolt 28 is again lowered and head 35 moves away from it, the nitrogen pressure prevents any upward backflow within the bolt.

FIG. 3 shows the terminal portion of a modification of the filling valve. The modification of FIG. 3 is similar to FIG. 1 in all respects not shown, and the same reference numbers are used for corresponding parts.

In the modification, bolt 28 is identical to the bolt of FIG. 1, but its terminal portion protruding into cavity 18 of housing 10 is guided in a tubular projection 100, having a liner 102, and bored along its periphery with a number of apertures 104 to allow flow from cavity 18 to terminal neck 20. The valve and its operation are otherwise identical to what has been disclosed above.

Although bolt 28 of FIG. 1 overhangs into cavity 18, in the modificationn of FIG. 3 the bolt is guided over all its length and in all positions, and is therefore stabler and less subjected to vibration and jamming, such as might arise in certain operating conditions.

I claim:

1. A bag filling valve for fluid products, particularly viscous products, comprising a housing (10) having a cavity (18) that can be supplied with the fluid product and which opens into a terminal neck (20) adapted to be inserted over a bag straw, means (22) for applying vacuum to the straw, means for introducing a predetermined dose of fluid product into the straw, and means for introducing a dose of an inert gas into the straw, characterized in that the means for introducing a dose of fluid product and the means for introducing a dose of an inert gas comprise in combination:

a hollow bolt (28), having a bore at its tip, the bolt being slidable in the housing between a neck-shutting position and a position in which its tip is remote from the neck mouth;

a hollow sheath (36) slidable within the hollow bolt (28), and having an aperture in communication with its inner space, for the supply of an inert gas;

a needle (34), axially slidable in the sheath with a clearance, and protruding with an enlarged head (35) within the terminal neck through the terminal bore of the bolt, the needle being biased by elastic means (38) toward a position where the enlarged head abuts against the tip of the bolt; and drive means (44) for removing the bolt and the needle from the terminal neck, for connecting it to the internal cavity of the housing, for subsequently bringing the bolt near the neck in order to break the connection and to push the needle and move its enlarged head away from the bolt, the needle portion adjacent to its enlarged head being smaller than the bore, so that gas fed to the hollow sheath is allowed to flow through.

2. The filling valve of claim 1, characterized in that said elastic means (38) comprise a helical compression spring interposed between an internal step in the bolt and an external step in the sheath.

3. The filling valve of claim 1, characterized in that said drive means (44) comprise a double-action pneumatic cylinder, having an operating rod (46) adapted to hook a groove (54) in the sheath by means of a bracket (52).

4. The filling valve of claim 1, characterized in that a transverse passage (21), connectable with a vacuum pump, opens into the terminal neck.

* * * * *

UNITED STATES PATENT AND TRADEMARK OFFICE

CERTIFICATE OF CORRECTION

PATENT NO. : 5,975,163
DATED : November 2, 1999
INVENTOR(S) : Angeli Gianfranco

It is certified that error appears in the above-identified patent and that said Letters Patent is hereby corrected as shown below:

On the title page item [75], should read --Gianfranco Angeli-- and item [19], should read --Angeli-- and insert item -- [30] Foreign Application Priority Data

July 18, 1997 [IT] Italy ..... TO97A000649 --.

Signed and Sealed this

Nineteenth Day of December, 2000

*Attest:*

Q. TODD DICKINSON

*Attesting Officer*

*Commissioner of Patents and Trademarks*